United States Patent [19]

Ready et al.

[11] Patent Number: 4,512,098

[45] Date of Patent: Apr. 23, 1985

[54] SIGN FRAME AND METHOD FOR FACTORY INSTALLING FLEXIBLE SIGN FACING MATERIAL THEREON

[75] Inventors: Robert J. Ready, Cincinnati, Ohio; Donald E. Whipple, Edgewood, Ky.; James P. Sferra, Pleasant Plain, Ohio

[73] Assignee: Lighting Systems Inc., Cincinnati, Ohio

[21] Appl. No.: 553,719

[22] Filed: Nov. 21, 1983

[51] Int. Cl.[3] ..... G09F 15/00

[52] U.S. Cl. ..... 40/610; 40/155; 40/564; 160/239

[58] Field of Search ..... 40/152, 156, 152.1, 40/619, 603, 617, 610, 155, 564; 160/239

[56] References Cited

U.S. PATENT DOCUMENTS

| | | | |
|---|---|---|---|
| 825,375 | 7/1906 | Booth | 38/102.6 |
| 1,069,494 | 8/1913 | Stranders | 40/539 |
| 1,186,456 | 6/1916 | Tracy | 38/102.6 |
| 1,202,066 | 10/1916 | Hughes | 40/155 |
| 1,686,368 | 10/1928 | Carter | 30/102.7 |
| 1,870,798 | 8/1932 | Einson | 40/603 |
| 2,187,870 | 1/1940 | Veccia | 40/610 |
| 2,193,928 | 3/1940 | Johnson | 40/603 |
| 2,404,089 | 7/1946 | Pollock | 40/539 |
| 3,859,742 | 1/1975 | Amaro | 38/102.4 |
| 4,176,480 | 12/1979 | Euzarraga | 40/603 |
| 4,194,313 | 3/1980 | Downing | 40/610 |
| 4,325,197 | 4/1982 | Achten et al. | 40/610 |

FOREIGN PATENT DOCUMENTS

| | | | |
|---|---|---|---|
| 15020 | of 1902 | United Kingdom | 40/610 |

OTHER PUBLICATIONS

Dorsey, Bill, "Flexible Film Review", *Signs of the Times;* Dec. 1981, pp. 52–65.

*Primary Examiner*—Gene Mancene
*Assistant Examiner*—Wenceslao J. Contreras

[57] ABSTRACT

In the manufacture of large signs, flexible sign facing material is fastened in stretched condition to a frame which is collapsed for shipping and erected at the job site to eliminate slack and restore its full length. Slide locking members are utilized.

20 Claims, 10 Drawing Figures

SIGN FRAME AND METHOD FOR FACTORY INSTALLING FLEXIBLE SIGN FACING MATERIAL THEREON

TECHNICAL FIELD

This invention relates to the factory installation of flexible sign facing material in the manufacture of large illuminated signs.

More particularly it relates to the installation of flexible sign facing material in the manufacture of internally lit fascias, e.g. canopy or building fascias.

BACKGROUND OF THE INVENTION

Flexible sign facing materials are ordinarily used for internally lit signs of length greater than 6 to 10 feet because such materials are readily available in continuous lengths whereby shadow producing seams are not a problem whereas conventional rigid materials, e.g. acrylics and polycarbonates, are available only in panels of short length because of strength problems and thus are not available for use in longer signs without shadow producing seams.

Because of shipping and handling problems, flexible material signs of greater than 12 feet, e.g. those used in canopy and building fascias such as those used for gasoline service stations, are ordinarily assembled at the job site, e.g. by contractors. Conventionally, the light box for the sign is shipped in sections and bolted together at the job site. The top and bottom and ends of the light box are used as the sign frame. The flexible sign facing material is attached at the bottom and then is progressively levered along its length into grooved structure at the top together with a retaining bar whereby the entire facing is attached in stretched condition. This requires special grooving and a special tool with ratchet like action. This is a tedious procedure and requires up to three to four days for four workers for a very large sign. Moreover, assembly is hindered by bad weather, especially strong winds.

SUMMARY OF THE INVENTION

Apparatus and method have now been discovered whereby the flexible sign facing material is installed in the factory despite dimensions exceeding the aforementioned 12 foot extent thereby reducing over 80% of the work required at the job site and also reducing the effect of bad weather and eliminating the need for the complicated grooved structure.

This is accomplished by utilizing a multi-section frame where the sections can be locked in alignment so the flexible sign facing material can be stretched over the assembly and fastened to it in stretched condition, and then released so the sign material can be folded so that it is slack at each fold and whereby the frame sections are caused to overlie one another to form an assembly of reduced length for transportation to the job site, and reassembled to full length condition with the frame sections locked in alignment at the job site.

The sign frame includes left and right end sections and can include one or more intermediate sections depending on the sign length. Preferably, each section is no more than 12 feet in length so for sign lengths greater than 24 feet, at least one intermediate section is preferably included, and for sign lengths greater than 36 feet, at least two intermediate sections are preferably included, etc. Preferably, each section is 10 or 12 feet in length.

Each end section comprises a vertical member, a first horizontal member extending between one end of the vertical member and a free end, and a second horizontal member extending between the other end of the vertical section and a free end, the three members forming an essentially C-shaped section. Each end section also includes bracing connecting the horizontal members.

Each intermediate section comprises top and bottom horizontal members, each with both ends free. The horizontal members are held together by at least one transverse bracing member.

Preferably, the bracing members are of a temporary, i.e. removable nature, so they can be removed on assembly of the sign and attachment of it to the light box so that they will not cause shadows to form on the sign facing on illumination of the sign.

Preferably, the frame is constructed of one inch square cross section tubing and is prepunched or predrilled on its rear side, i.e. the side opposite the sign face, with a plurality of spaced apertures for attachment of the marginal portions of the sign facing thereto, e.g. with pop rivets.

The frame can also include spacer or insert members to allow the aforementioned frame sections to be spaced from one another on attachment of the sign facing thereto so that on releasing of the sign frame to the shipping position, the sign facing can be folded and the frame sections moved to overlie one another with the frame sections on the inside of the fold while leaving slack at the fold, i.e. without exerting undue tension at the fold. This allows utilizing a multi-section frame folded in accordian fashion. The spacer or insert members preferably are constructed of the same material as the rest of the frame, e.g. one inch square cross section tubing, and are retained in the assembly by being fastened to the sign facing, e.g. by riveting, and are confined within locking structure when the frame sections are locked in alignment. The spacing between the frame sections to allow slack at the fold despite positioning of the frame sections inside the fold should be a dimension at least about equal to the sum of the transverse dimensions (i.e. the dimension of the frame perpendicular to the sign facing) of the adjacent frame sections.

The sign frame also includes locking structure which functions to lock the frame sections in alignment for the initial fastening of the sign facing to the frame in stretched condition, for the release of the frame assembly to shipping position, and for locking the frame sections in alignment after reassembly at the job site. Preferably, the locking structure includes connecting structure for adjacent free ends of horizontal members of the frame sections. Each such connecting structure is very preferably in the form of a slidable member which can be retained in a stored position partly encompassing one of the two horizontal members it is to connect (e.g. by fastening in holes in a horizontal member using screws), and slid to bridge the adjacent ends of the two members to align the frame sections and fastened in place, e.g. using screws to fasten the slidable member to both the horizontal members, to lock the frame sections in alignment. Very preferably the slidable members each include a channel shaped portion and a retention and guiding portion depending from one leg of the channel shaped portion so that there is an opening between the retention and guiding portion and the other leg of the channel shaped portion, and the slidable members are positioned on the horizontal members with the openings at the rear face of the frame. The retention and guiding portion functions to retain its slidable member against removal from the frame in a transverse direction and also to guide the member in sliding in a longitudinal direction. The opening left between the retention and guiding portion and the other leg of the channel portion accommodates for the means fastening the sign facing to the frame (e.g. rivets) and allows the slidable members to move on the horizontal members despite the fastening means and attached sign facing material. When the spacer or insert members are positioned between horizontal members of adjacent frame sections, the slidable members have a length and are designed to bridge the horizontal members they are to connect as well as to confine the spacer/insert therebetween. The preferred locking members herein which function to slide on horizontal members of the frame sections to bridge adjacent horizontal members to lock them in alignment will sometimes be referred to herein as slide locks.

Factory installation of flexible sign facing material on the frame is carried out as follows.

The frame sections are held aligned in a plane to temporarily form a rigid frame assembly. This is done by positioning the frame sections in a plane butting end-to-end where no spacers are used and abutting the spacers where these are used, and moving the slide locks to bridge the horizontal members (legs) of adjacent frame sections and confine any intervening spacers, and fastening the slide locks in the bridging position.

Then flexible sign facing material is fastened to the assembly in stretched condition, preferably by positioning the frame assembly over the flexible material, attaching the material to the rear frame surface at one end using pop rivets, stretching in the direction of the other end and attaching the material to the rear frame surface at that end, attaching the material along the length of the rear frame surface at one side using pop rivets, and then stretching and fastening along the length of the rear frame surface at the other side using pop rivets.

The frame assembly is then released so the sections are movable with respect to one another by unfastening the slide locks, moving them from the bridging mode to storage position, i.e. where each slide lock is on only one leg of a frame section, and fastening them in such storage position.

Then, the sign facing is folded at each joint between frame sections and the frame sections are moved to overlie one another. Where spacers are not used, folding is so that frame sections are on the outside of the fold so that the frame sections will not stretch and tension the sign facing on folding. Where spacers are used, folding can be so that the frame sections are on the inside of the fold and the fold will still be slack. The result is a sign of reduced length compared to the rigid frame assembly.

The sign thus having been collapsed to its shipping position is easily handled and is readily wrapped in protective wrapping and boxed for transportation to the job site, i.e. where the fascia is to be set up.

Once at the location of the job site, the collapsed sign is readily erected by unfolding to align the frame sections and flipping any spacers into aligned position so that adjacent frame sections and spacers are abutting thereby restoring tension to the slack areas of the sign facing material and providing a planar sign face.

The assembly is then locked in the aligned position by unfastening the slide locks from their storage positions, moving them to bridge adjacent frame section legs and to confine any intervening spacers, and fastening them in bridging position, e.g. using screws.

The sign panel which is formed is then readily attached, e.g. by bolting, to the light box whereupon the bracing members are removed from the frame. The light box and frame are interrelated in design so that the frame is held under tension on bolting together of the assembly despite removal of the bracing.

The term "multi-section" is used herein to mean more than one section.

The term "fascia" is used herein to mean an assembly including a sign facing.

The term "canopy" is used herein to mean a roof-like structure such as those over pump islands in gasoline service stations.

The term "stretch" is used herein to mean to draw tight to eliminate all slack and ripples.

DESCRIPTION OF THE DRAWING

Preferred embodiments are illustrated in the figures of the drawing in which.

DETAILED DESCRIPTION

Figure 1:
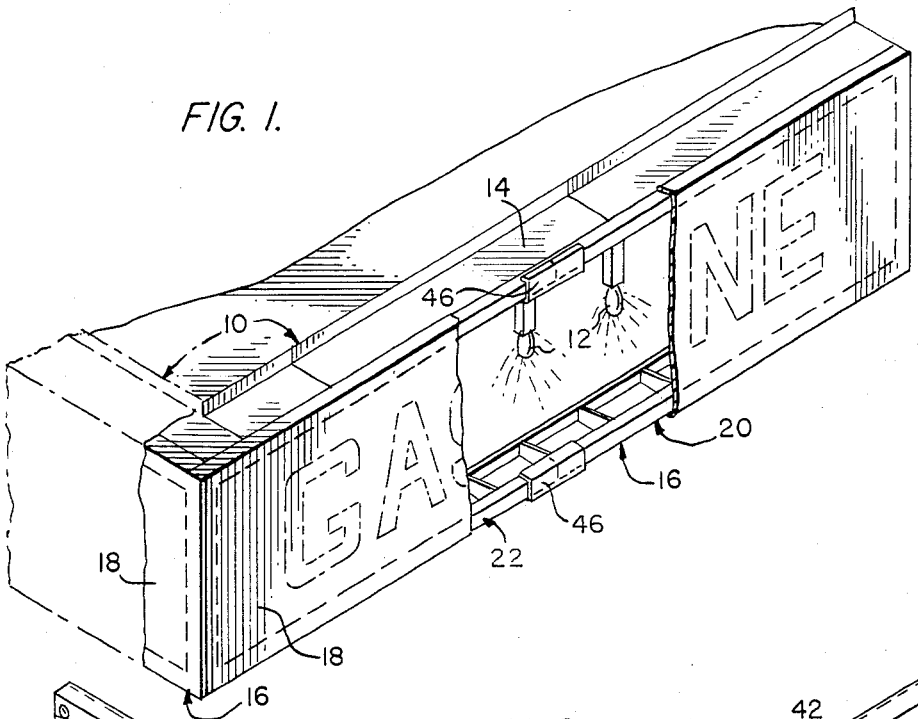
FIG. 1 is a perspective view of a portion of an internally lit canopy fascia including flexible sign facing material mounted on a frame within the scope of the invention which in turn is mounted on the light box, with portions broken away to depict internal structure.

Referring to FIG. 1, sign structure is depicted incorporating the frame of the invention and assembled by the method of the invention and is mounted on canopy structure.

The canopy structure includes a lighting module or light box 10, e.g. of aluminum containing appropriate reflectors (not depicted) and lamps 12 which are accessible through top covers 14. The lamps can be, for example, of the high intensity discharge type (e.g. 75 watt mercury vapor lamps) or 800 milliamp high output fluorescent lamps.

Frames 16 with attached flexible sign facing material 18 are mounted on light box structure on each side of the canopy and the designs of these cooperate so the sign frames are held under tension and do not need bracing.

The sign frames 16 each include right and left end sections 20 and 22 which are locked in aligned position, i.e. so that each sign face is planar and taut, i.e. without slack or ripples, by slide locks 46 which bridge the free ends of the legs of the end sections and are fastened in place, e.g. with screws (not shown).

The flexible sign facing material 18 is preferably flexible film which is what the sign trade calls a substrate of polyvinylchloride reinforced with polyester scrim. Flexible film is a translucent high strength material. It can be used from a continuous roll and can be ordered screen printed in any length so there are no vertical seams to cast shadows. It resists blowing out and fading. It is stretched, i.e. drawn tight, according to the specifications of the manufacturer, e.g. one-sixteenth of an inch per foot, without distortion of the printing.

We turn now to various embodiments of the sign frame of the invention in more detail.

Figure 2:
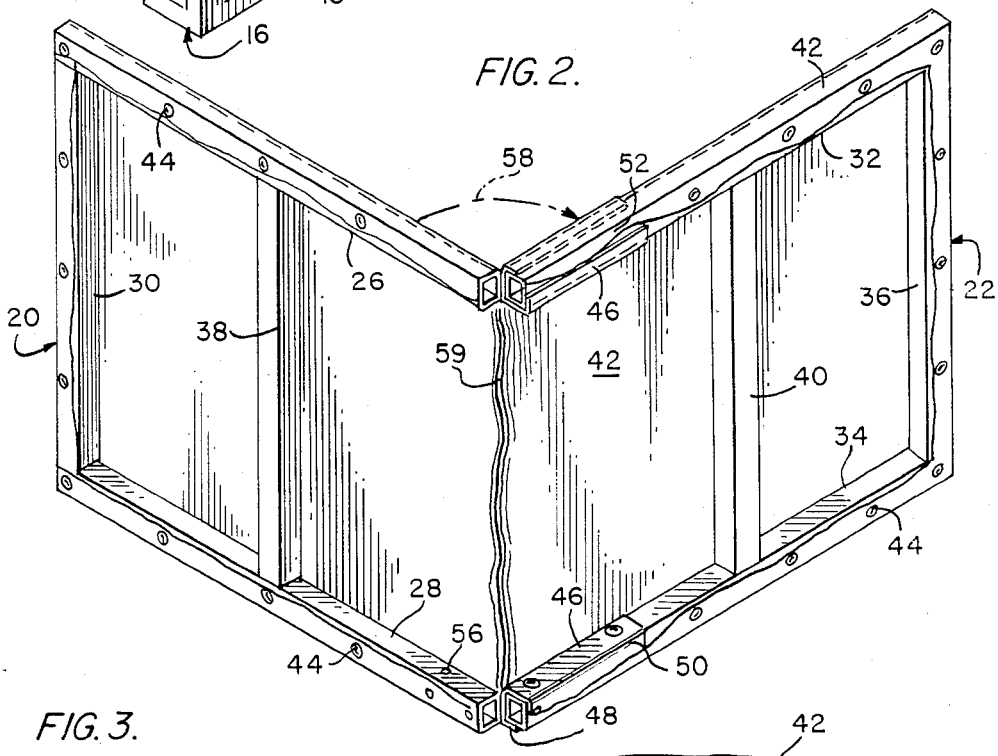
FIG. 2 is a rear perspective view of a sign frame within the scope of the invention having flexible sign facing material attached thereto in partly folded position.
Figure 3:
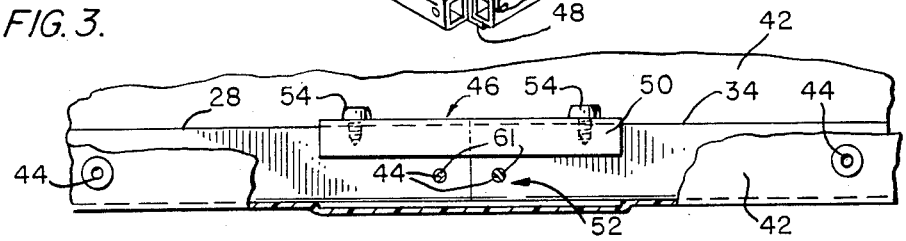
FIG. 3 is a partial rear view of the frame and facing of FIG. 2 with the frame sections aligned and the slide locks fastened in bridging position, with part of the facing material removed to show the slide lock structure.

FIGS. 2 and 3 depict a frame including end sections 20 and 22. The section 20 includes a top horizontal member or leg 26 and a bottom horizontal member of leg 28 and a vertical member 30 which joins these. The section 22 includes a top horizontal member or leg 32 and a bottom horizontal member or leg 34 and a vertical member 36. The section 20 includes brace 38 and the section 22 includes brace 40. The braces are wedged in or otherwise removably emplaced and function to keep the legs the specified distance apart until the frame is assembled and permanently mounted on the light box whereupon they are removed. Fastened stretched over the frame is flexible sign facing 42. The sign facing 42 is wrapped over the frame and is attached by pop rivets 44 to members 30, 36, 26, 32, 28 and 34. The frame includes slide locks 46. Each slide lock 46 has a channel shaped portion 48 and has a retention and guiding portion 50 depending from one leg of the channel shaped portion and there is an opening 52 between the portion 50 and the other leg of portion 48 to accommodate for rivets 44 and to allow it to slide on a horizontal member despite the rivets and attached flexible facing material. FIG. 2 depicts the slide locks 46 attached in storage position to legs 32 and 34 by screws 54 and holes are provided in legs 26 and 28 (hole 56 is depicted in leg 28) for fastening the slide locks when moved to bridge adjacent legs. The arrow 58 in FIG. 2 schematically depicts the assembly being moved to collapsed position, i.e. the sign facing 42 being folded on fold line 59 and the section 20 being moved to overlie section 22 with the sign facing between the frame sections so that there is slack at fold line 59. FIG. 3 illustrates the frame sections in the aligned position where the sign facing is in one plane, i.e. flat, and the slide locks 46 have been slid to bridge the legs of the members 20 and 22 and are fastened in place by screws 54 to lock the frame in the aligned position; holes 61 are for rivets to hold the sign facing adjacent the edges of the frame sections.

Figure 4:
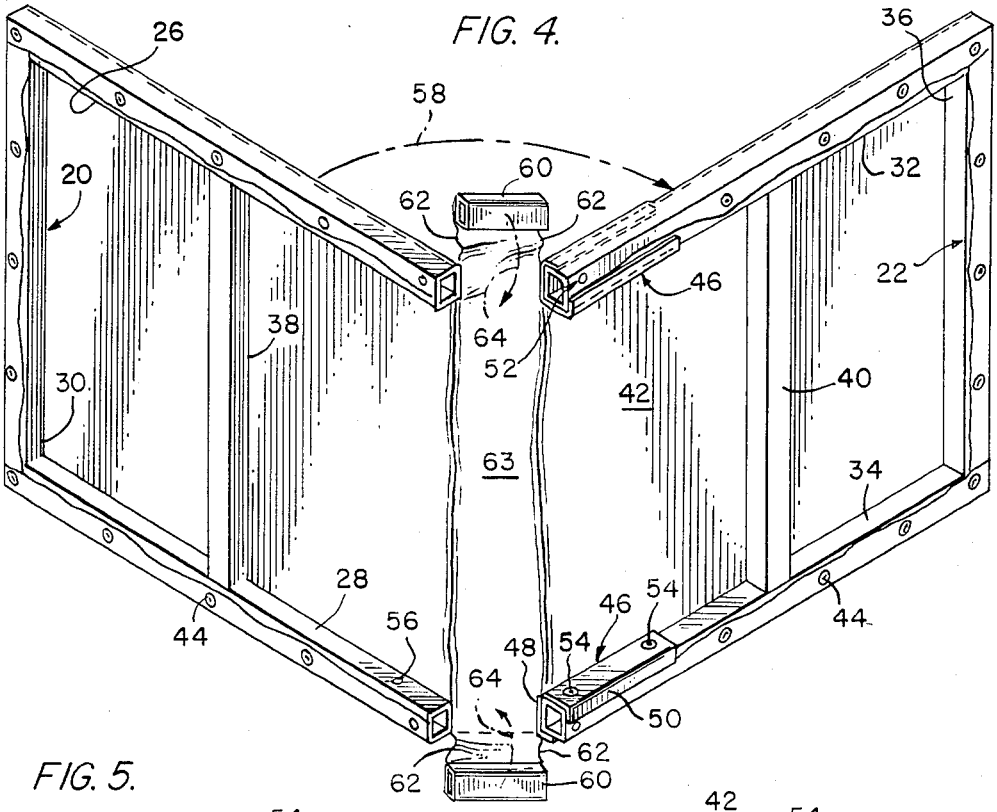
FIG. 4 is similar to FIG. 2 but depicts an embodiment including spacers.
Figure 5:
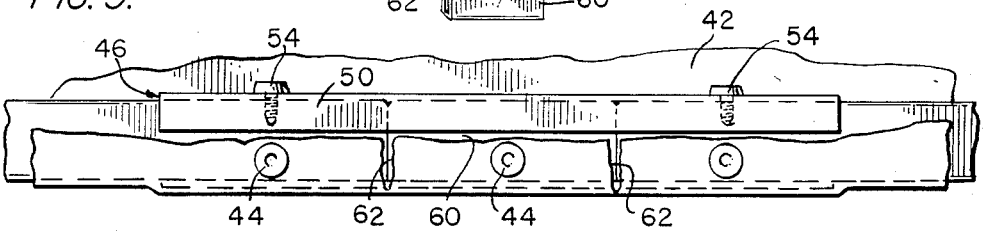
FIG. 5 is a partial rear view of the sign of FIG. 4 with the frame sections aligned and with the slide locks fastened in bridging position and confining the spacers.
Figure 6:
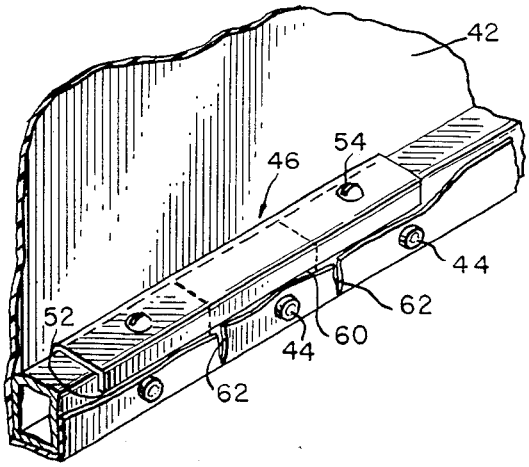
FIG. 6 is a perspective view of what is depicted in FIG. 5.

FIGS. 4–6 illustrate an embodiment similar to that of FIGS. 2 and 3 except that spacers are utilized between the frame sections. Thus, FIGS. 4–6 as do FIGS. 2 and 3, depict a frame including sections 20 and 22 with horizontal members, i.e. legs. 26, 28, 32 and 34, and vertical members 30 and 36, and braces 38 and 40, and slide locks 46 with channel portions 48 and retention and guiding portions 50, with sign facing material 42 wrapped around the frame and fastened to the rear face of the frame by rivets 44, and the opening 52 (FIG. 6) in the slide locks accommodating for rivets 44 and allowing the slide locks to slide on the horizontal members despite the rivets and attached flexible facing material. The embodiment of FIGS. 4–6 differs from the embodiment of FIGS. 2 and 3 in including spacers 60. The spacers 60 are fastened to the sign facing material by riveting as shown in FIGS. 5 and 6, and the sign facing material is cut along lines 62 so that the spacers can be moved from alignment with the frame sections. The spacer 60 at the top is depicted held upwardly from its real drooping position so that the adjacent structure can be viewed. The arrows 64 in FIG. 4 schematically illustrate moving of the spacers 60 into position adjacent the legs of the frame sections on movement of the frame sections to aligned position. FIG. 4 depicts the slide locks 46 attached in storage position to legs 32 and 34 by screws 54 and holes are provided in legs 26 and 28 (hole 56 is depicted in leg 28) for fastening the slide locks in place after they have been moved to bridge adjacent legs. The arrow 58 in FIG. 4 schematically depicts the assembly being moved to collapsed position, i.e. the sign facing 42 being folded along fold area 63 and the section 20 being moved to overlie section 22 with the sign facing between the frame sections. Contrary to the embodiment of FIGS. 2–3, this embodiment can also be folded, i.e. collapsed, so that frame sections are on the inside of the fold and there will still be slack, i.e. no harmful tension, at the area of folding. FIGS. 5 and 6 illustrate the frame sections in the aligned position and the spacers 60 moved into position as per arrows 64 (FIG. 4) so that the sign face is in one plane, i.e. flat, and the slide locks 46 have been slid to bridge the legs of members 20 and 22 and confine the spacers 60 therebetween, and the slide locks 46 have been fastened in place by screws 54 to lock the frame in the aligned position.

Figure 7:
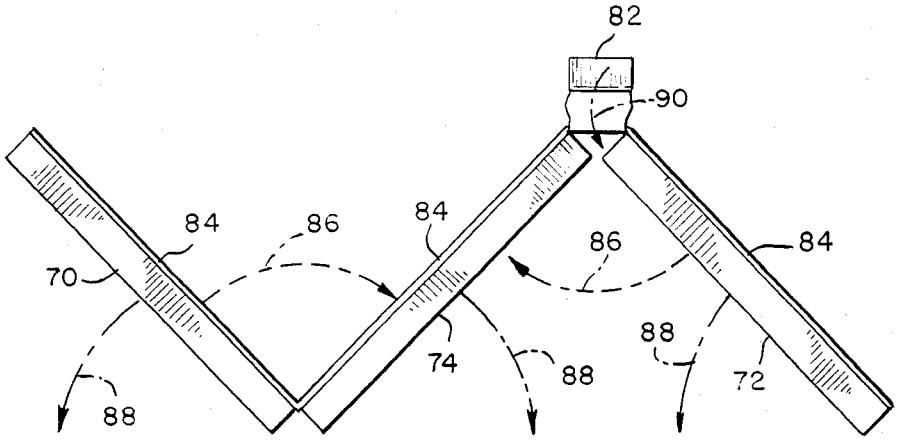
FIG. 7 is a schematic representation of a plan view of a three section frame within the scope of the invention with flexible sign facing material thereon with the slide locks and facing material normally wrapping around the top and rear of the frame left out, with bracing and apertures not depicted, with the facing material thickness exaggerated so as to be evident. The frame is depicted in partly folded position.
Figure 7A:
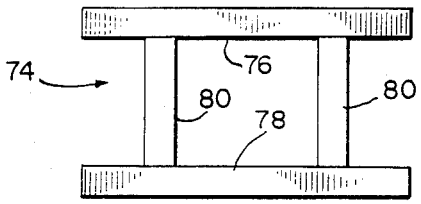
FIG. 7A is a front view of the intermediate section of the frame of FIG. 7 but with temporary bracing depicted.
Figure 8:
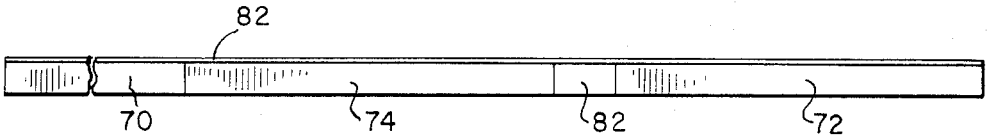
FIG. 8 is a schematic representation of the embodiment of FIG. 7 with the frame sections depicted in aligned condition.
Figure 9:
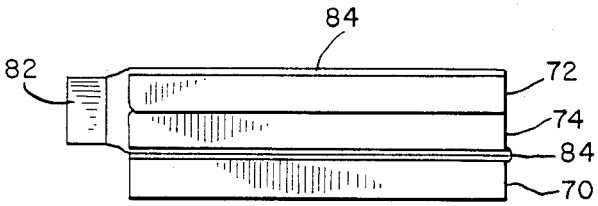
FIG. 9 is a schematic representation of the embodiment of FIG. 7 with the frame depicted in collapsed condition.

FIGS. 7–9 schematically illustrate an embodiment with three frame sections with no spacers between the first and second sections but with spacers between the second and third sections. The slide locks are not depicted so as to simplify the illustration. This embodiment includes end sections 70 and 72 and intermediate section 74. The end sections 70 and 72 are similar to end sections 20 and 22 depicted in FIGS. 2 and 4. As depicted in FIG. 7A, the intermediate section 74 includes top and bottom horizontal members 76 and 78 and braces 80 which are removably attached and function to maintain the members 76 and 78 the desired distance apart until the frame is assembled and permanently mounted on the light box whereupon they are removed. As illustrated in FIG. 7, spacers 82 are utilized between the sections 74 and 72. The sign facing material 84 exaggerated in thickness so as to be evident is depicted fastened to the three frame sections and the top spacer 82 is illustrated attached to a facing material tab defined by cutting into the facing material wrapped over the top and rear of the frame. The arrows 86 in dashed lines schematically illustrate folding of the sign facing along predetermined fold lines or areas between frame sections and moving of the frame sections 70, 74 and 72 to overlie one another to provide a collapsed structure as schematically illustrated in FIG. 9 with the frame sections 72 and 74 inside the fold adjacent the spacers 82 and the frame sections 70 and 74 outside the fold where no spacers are used. The arrows 88 in phantom schematically illustrate moving the frame sections to aligned position and the arrow 90 illustrates moving the spacers 82 into position adjacent the horizontal members of the adjacent frame sections, this combination causing the frame to achieve the aligned, i.e. erect, position as schematically represented in FIG. 8 where the frame can be locked in such position using the slide locks (not depicted).

As is illustrated in FIGS. 7–9, when more than two frame sections are utilized, the preferred embodiment includes spacers at every other joint between frame sections, i.e. at every other predetermined fold, so that folding can be carried out accordian style with the spacers allowing every other fold to be carried out with the frame inside the fold without subjecting the sign facing to harmful tensioning.

We turn now to the preferred method for factory installing sign facing material on the aforedescribed frames.

The sign facing material is laid on a table. The frame sections (sections 20 and 22 in the embodiment FIGS. 2–6 and sections 70, 74 and 72 in the embodiment of FIGS. 7–9) are then aligned in order as predetermined with any spacers (spacers 60 in the embodiment of FIGS. 4–6 and spacers 82 in the embodiment of FIGS. 7–9) inserted between frame sections as predetermined, and the sections and spacers are butted together.

Then the slide locks (slide locks 46 in the embodiments of FIGS. 2–6; not depicted in the embodiment of FIGS. 7–9) are moved from their storage positions to join adjacent frame sections by bridging adjacent horizontal members of the sections (i.e. bridging members 28 and 34 and also members 26 and 32 in the embodiments of FIGS. 2–6) and confining any spacers (slide locks 46 confine spacers 60 in the embodiment of FIGS. 4–6). The slide locks are fastened in place using screws 54 to temporarily form a rigid frame assembly. While the fastening step is not required, it is very preferred as it assures the holes for the screws in the slide locks will line up with the holes for the screws in the frame assembly when it is erected from collapsed state at the job site.

Then, the frame assembly and flexible sign facing material are clamped at one end and the flexible material is wrapped around this end and riveted to the back surface of the frame at this end. A stretching clamp is then positioned at the other end and used to stretch the material toward that end according to manufacturer's specifications to draw it tight and remove slack and ripples and to wrap it around that end, and then the sign facing material is riveted to the back surface of the frame at that end. Clamping is then discontinued. The sign facing material is then wrapped around the length of the frame on one side and is riveted to the back frame surface at this side. Following this, the sign facing material is wrapped around the other side and portion by portion is stretched toward that side to manufacturer's specification by gripping and levering against the frame and riveting to fasten the sign facing material in stretched, i.e. taut, condition.

The screws 54 are then removed from the slide locks 46, and these are slid along the horizontal members of the frame so that each slide lock is positioned on only one horizontal member and is fastened to that horizontal member in storage position holes using the screws 54.

The frame sections (sections 20 and 22 for the embodiments of FIGS. 2–6 and sections 70, 74 and 72 for the embodiment of FIGS. 7–9) are then moved to overlie one another, and the sign facing is folded (along line of fold 59 in the embodiment of FIGS. 2–3 and along fold area 63 in the embodiment of FIGS. 4–6) so there is slack at the line of fold (i.e. so that frame sections are outside the fold in the embodiment of FIGS. 2–3 and for sections 70 and 74 for the embodiment of FIGS. 7–9). In the embodiment of FIGS. 7–9, the folding is zig-zag or accordian fashion as per FIG. 9. The formed assembly is of reduced length compared to the length of the rigid frame assembly (e.g. in the embodiment of FIGS. 7–9, it is about one-third the length of the rigid frame assembly as seen by comparing FIGS. 9 and 8), and thus has been collapsed for ease of handling and shipment. It is then, very preferably wrapped and boxed for protection.

The boxed collapsed structure is readily shipped to the job site, i.e. the location where the fascia is to be set up.

Once at the job site, it is readily removed from the boxing, and the collapsed sign is erected by unfolding to align the frame sections (sections 20 and 22 in the embodiments of FIGS. 2–6 and sections 70, 74 and 72 in the embodiment of FIGS. 7–9) and the spacers are flipped over and inserted into alignment between the adjacent frame sections so that the adjacent frame sections and spacers are abutting and are aligned in a plane to restore tension to the sign facing. Thus, in the embodiment of FIGS. 2 and 3, sections 20 and 22 are aligned in a plane in abutting relation; in the embodiment of FIGS. 4–6, the sections 20 and 22 are aligned and spacers 60 flipped over and inserted therebetween so that these are in abutting relation; in the embodiment of FIGS. 7–9, the sections 70, 74 and 72 are moved into alignment in a plane and spacers 82 flipped over and inserted between sections 74 and 72.

Then the screws (reference numeral 54 in the embodiment of FIGS. 2–6) are removed to release the slide locks (not depicted in the embodiment of FIGS. 7–9) from storage position, and the slide locks are slid to bridge the horizontal members of adjacent frame sections and confine the spacer members therebetween (spacer members 60 for the embodiment of FIGS. 2–6 and spacer members 82 for the embodiment of FIGS. 7–9), and the slide locks are fastened in the bridging, i.e. alignment locking, position using screws.

The erected sign panel is now lifted in one piece and is attached to the light box whereupon braces 38 and 40 (FIGS. 2–6) and 80 (FIG. 7A) are removed and the light box holds the sign panel under tension so the bracing is not necessary.

The labor at the job site is significantly less than if the sign facing were stretched and attached at the job site thus mitigating interference by weather and interference with business at the job site.

While the foregoing describes preferred embodiment, modifications within the scope of the invention will be readily evident to those skilled in the art.

For example, fastening means besides rivets can be used, e.g. adhesive means such as glue, or clips, or a groove used in association with a retaining bar.

Moreover, if desired the bracing can be incorporated into the design of the sign so the shadows formed on illumination have aesthetic function or form part of the sign indicia.

Moreover, signs with more than two sections can be designed to collapse in configurations different from the accordian configuration illustrated in FIG. 9. For example, a three section frame can include an intermediate section which is twice as big as each end section, and each end section can be moved to overlie half of the intermediate section. Or a three section frame can be constructed as in FIGS. 7–9 but with a spacer equal in length to the sum of the transverse dimensions of the three sections so that the end section without the spacer can be folded to be sandwiched between the intermediate section and the other end section.

Thus, the scope of the invention is intended to be defined by the claims.

What is claimed is:

1. Sign frame whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising (a) left and right end sections, each section comprising
  (i) a vertical member,
  (ii) a first horizontal member rigidly and fixedly connected to the vertical member and extending between one end of the vertical member and a free end,
  (iii) a second horizontal member rigidly and fixedly connected to the vertical member and extending between the other end of the vertical member and a free end, and
  (iv) rigid bracing means connecting the horizontal members, and (b) means for locking the left and right end sections in alignment, said locking means comprising means slidable on a horizontal member to partly encompass the free end of an adjacent horizontal member.

2. Sign frame as recited in claim 1, in which the slidable means has a channel shaped portion and has a retention and guiding portion depending from one leg of the channel shaped portion.

3. Sign frame as recited in claim 2, in which the end sections contain holes spaced over their extent for use in riveting flexible sign facing material to the frame and the slidable means contains an open portion between the retention and guiding portion and the other leg of the channel shaped portion to accommodate for rivets and to allow the slidable means to move on a horizontal member despite rivets and attached sign facing material.

4. Sign frame as recited in claim 3, in which the locking means comprises a first connector means adapted to lock the first horizontal member of one end section in alignment with the first horizontal member of the other end section and second connector means adapted to lock the second horizontal member of one end section in alignment with the second horizontal member of the other end section.

5. Sign frame as recited in claim 4, in which the bracing means is removable.

6. Sign frame whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising (a) left and right end sections, each section comprising
  (i) a vertical member,
  (ii) a first horizontal member rigidly and fixedly connected to the vertical member and extending between one end of the vertical member and a free end,
  (iii) a second horizontal member rigidly and fixedly connected to the vertical member and extending between the other end of the vertical member and a free end, and
  (iv) rigid bracing means connecting the horizontal members, and (b) means for locking the left and right end sections in alignment;

said sign frame additionally comprising at least one intermediate section, each intermediate section comprising top and bottom horizontal members, each with both ends free, and at least one bracing member connecting the horizontal members, and in which the means (b) is for locking the left and right end sections and the intermediate sections in alignment.

7. Sign frame as recited in claim 6, in which said bracing means and said bracing members are removable.

8. Sign frame as recited in claim 7, in which the sign frame additionally comprises top and bottom spacer members for each intermediate member to be inserted between the free ends of the horizontal members on one side of the intermediate member and the free ends of adjacent horizontal members.

9. Sign frame as recited in claim 8, in which the locking means comprises means slidable on a horizontal member to partly encompass the free end of an adjacent horizontal member and to confine any spacer member inserted between the horizontal members.

10. Sign frame as recited in claim 7, in which the sign frame includes one intermediate section and first and second spacer members for insertion between the free ends of the horizontal members on one side of the intermediate section and the adjacent free ends of the horizontal members of one end section.

11. Sign frame as recited in claim 10, in which the locking means comprises a slidable member for connecting each free end of a horizontal member of an end section with the adjacent free end of a horizontal member of the intermediate section, with the slidable members on the side where the spacer members are utilized being of a length to connect the free ends of adjacent horizontal members and confine the spacer member inserted therebetween.

12. Sign frame as recited in claim 11, in which each slidable member has a channel shaped portion and has a retention and guiding portion depending from one leg of the channel shaped portion.

13. Sign frame as recited in claim 12, in which the end sections and the intermediate section contain holes spaced over their extent for use in riveting flexible sign facing material to the frame and the slidable members contain an open portion between the retention and guiding portion and the other leg of the channel shaped portion to accommodate for rivets and to allow the slidable member to move on a horizontal member despite rivets and attached sign facing material.

14. Sign frame whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising (a) left and right end sections, each section comprising
  (i) a vertical member,
  (ii) a first horizontal member rigidly and fixedly connected to the vertical member and extending between one end of the vertical member and a free end,
  (iii) a second horizontal member rigidly and fixedly connected to the vertical member and extending between the other end of the vertical member and a free end, and
  (iv) rigid removable bracing means connecting the horizontal members, and (b) means for locking the left and right end sections in alignment;

said sign frame being interrelated in design with a light box with which it is to be associated so that the frame is held under tension on attachment of it to the light box so the bracing means can be removed;

said sign frame additionally comprising first and second spacer members with the first spacer member being for insertion between the free ends of the first horizontal members and the second spacer member being for insertion between the free ends of the second horizontal members, and in which the locking means includes slidable means to connect the free ends of adjacent horizontal members and confine the spacer member inserted therebetween.

15. Sign frame whereby flexible sign facing material can be factory installed on said frame in the manufacture of fascias having a dimension exceeding 12 feet to provide an assembly which can be collapsed for transportation and restored to full length at the job site, said sign frame comprising (a) left and right end sections, each section comprising
  (i) a vertical member,
  (ii) a first horizontal member extending between one end of the vertical member and a free end,
  (iii) a second horizontal member extending between the other end of the vertical member and a free end, and
  (iv) bracing means connecting the horizontal members, and (b) means for locking the left and right end sections in alignment, said locking means comprising means slidable on a horizontal member to partly encompass the free end of an adjacent horizontal member.

16. Sign frame as recited in claim 15, in which the slidable means has a channel shaped portion and has a retention and guiding portion depending from one leg of the channel shaped portion.

17. Sign frame as recited in claim 16, in which the end sections contain holes spaced over their extent for use in riveting flexible sign facing material to the frame and the slidable means contains an open portion between the retention and guiding portion and the other leg of the channel shaped portion to accommodate for rivets and to allow the slidable means to move on a horizontal member despite rivets and attached sign facing material.

18. Sign frame as recited in claim 17, in which the locking means comprises a first connector means adapted to lock the first horizontal member of one end section in alignment with the first horizontal member of the other end section and second connector means adapted to lock the second horizontal member of one end section in alignment with the second horizontal member of the other end section.

19. Sign frame as recited in claim 18, in which the bracing means is removable.

20. Sign frame as recited in claim 15, in which the sign frame additionally comprises at least one intermediate section, each intermediate section comprising top and bottom horizontal members, each with both ends free, and at least one bracing member connecting the horizontal members, and in which the means (b) is for locking the left and right end sections and the intermediate sections in alignment.

* * * * *

UNITED STATES PATENT AND TRADEMARK OFFICE

CERTIFICATE OF CORRECTION

PATENT NO. : B1 4,512,098

DATED : May 1, 1990

INVENTOR(S) : Robert J. Ready et al

It is certified that error appears in the above-identified patent and that said Letters Patent is hereby corrected as shown below:

Column 1, lines 18-19, after "19" delete --having been finally determined to be unpatentable, --.

Signed and Sealed this

Eleventh Day of September, 1990

*Attest:*

HARRY F. MANBECK, JR.

*Attesting Officer*

*Commissioner of Patents and Trademarks*

REEXAMINATION CERTIFICATE (1260th)

United States Patent [19]

Ready et al.

[11] B1 4,512,098

[45] Certificate Issued May 1, 1990

[54] SIGN FRAME AND METHOD FOR FACTORY INSTALLING FLEXIBLE SIGN FACING MATERIAL THEREON

[75] Inventors: Robert J. Ready, Cincinnati, Ohio; Donald E. Whipple, Edgewood, Ky.; James P. Sferra, Pleasant Plain, Ohio

[73] Assignee: LSI Lighting Systems Inc.

Reexamination Request:
No. 90/001,791, Jun. 16, 1989

Reexamination Certificate for:

| | |
|---|---|
| Patent No.: | **4,512,098** |
| Issued: | **Apr. 23, 1985** |
| Appl. No.: | **553,719** |
| Filed: | **Nov. 21, 1983** |

[51] Int. Cl.[5] ..... G09F 15/00

[52] U.S. Cl. ..... 40/610; 40/155; 40/564; 160/239

[58] Field of Search ..... 40/152, 156, 152.1, 40/155, 619, 603, 617, 610, 564; 160/239

[56] References Cited

U.S. PATENT DOCUMENTS

| | | | |
|---|---|---|---|
| 302,535 | 7/1884 | Holabird . | |
| 326,437 | 9/1885 | Marsh . | |
| 379,356 | 3/1888 | Beedle . | |
| 578,649 | 3/1897 | Mass . | |
| 811,322 | 1/1906 | Poltock . | |
| 825,375 | 7/1906 | Booth | 38/102.6 |
| 835,271 | 11/1906 | Adler . | |
| 847,327 | 3/1907 | Fitzgerald . | |
| 895,744 | 8/1908 | Goldberger . | |
| 1,024,905 | 4/1912 | McKelvey . | |
| 1,069,494 | 8/1913 | Stranders | 40/539 |
| 1,151,594 | 8/1915 | Hough . | |
| 1,186,456 | 6/1916 | Tracy | 38/102.6 |
| 1,202,066 | 10/1916 | Hughes . | |
| 1,204,329 | 11/1916 | Wilkins . | |
| 1,239,877 | 9/1917 | Bush . | |
| 1,407,237 | 2/1922 | Thompson et al. . | |
| 1,504,889 | 8/1924 | Hansen . | |
| 1,520,486 | 12/1924 | Sodemann . | |
| 1,662,586 | 3/1928 | Newman . | |
| 1,686,368 | 10/1928 | Carter, Jr. | 38/102.7 |
| 1,788,096 | 1/1931 | Friedmann . | |
| 1,846,496 | 2/1932 | Mills . | |
| 1,870,798 | 8/1932 | Einson | 40/603 |
| 1,900,274 | 3/1933 | Brockie . | |
| 1,923,247 | 8/1933 | Wood . | |
| 2,135,419 | 11/1938 | Wesseler . | |
| 2,145,353 | 1/1939 | Holmes . | |
| 2,187,870 | 1/1940 | Veccia | 40/610 |
| 2,193,928 | 3/1940 | Johnson | 40/154 X |
| 2,290,430 | 7/1942 | Heiser . | |
| 2,296,358 | 9/1942 | Marinsky et al. . | |
| 2,404,089 | 7/1946 | Pollock | 40/539 |
| 2,502,597 | 4/1950 | Scott . | |
| 2,578,868 | 12/1951 | Warrick . | |
| 2,694,441 | 11/1954 | Degenfelder . | |
| 2,708,960 | 5/1955 | Shephard . | |
| 2,722,967 | 11/1955 | Reinholz . | |
| 2,746,769 | 5/1956 | Hoogendoorn . | |
| 2,748,955 | 6/1956 | Anselmo . | |
| 2,757,677 | 8/1956 | Denn . | |
| 2,784,779 | 3/1957 | Knipfer et al. . | |
| 2,818,875 | 1/1958 | Denn . | |
| 2,819,901 | 1/1958 | Mateja . | |
| 2,827,955 | 3/1958 | Hurley . | |
| 2,840,400 | 6/1958 | D'Azzo . | |
| 2,878,059 | 3/1959 | Limle . | |
| 2,960,992 | 11/1960 | Klipfel . | |
| 3,054,325 | 9/1962 | Crockwell . | |
| 3,121,881 | 2/1964 | Schnell . | |
| 3,133,549 | 5/1964 | Severing . | |
| 3,164,397 | 1/1965 | Kilmer . | |
| 3,241,271 | 3/1966 | Berg . | |
| 3,451,153 | 6/1969 | Dohanyos . | |
| 3,465,461 | 9/1969 | Price et al. . | |
| 3,547,475 | 12/1970 | Gingher . | |
| 3,583,466 | 6/1971 | Dreyer . | |
| 3,671,062 | 6/1972 | Ashworth . | |
| 3,858,989 | 1/1975 | Field . | |
| 3,859,742 | 1/1975 | Amaro | 38/102.4 |
| 3,900,269 | 8/1975 | Pavlot . | |
| 3,912,404 | 10/1975 | Katt . | |
| 3,912,405 | 10/1975 | Katt . | |
| 3,946,916 | 3/1976 | Lawrence . | |
| 3,985,461 | 10/1976 | Gebhard . | |
| 4,074,452 | 2/1978 | Bellinder . | |
| 4,148,332 | 4/1979 | Huddle . | |
| 4,176,480 | 12/1979 | Euzarraga et al. | 40/155 |
| 4,185,679 | 1/1980 | Weir . | |
| 4,194,313 | 3/1980 | Downing . | |
| 4,228,842 | 10/1980 | Clark . | |
| 4,317,302 | 3/1982 | Von De Linde . | |
| 4,323,260 | 4/1982 | Suchy . | |
| 4,325,197 | 4/1982 | Achten et al. | 40/155 X |
| 4,452,000 | 6/1984 | Gandy . | |
| 4,459,773 | 7/1984 | Sandlin et al. . | |

FOREIGN PATENT DOCUMENTS

| | | |
|---|---|---|
| 15935 | 8/1926 | Netherlands . |
| 15020 | of 1902 | United Kingdom . |

OTHER PUBLICATIONS

Dorsey, Bill, "Flexible Film Review," Signs of the Times; Dec. 1981, pp. 52–65.

*Primary Examiner*—James R. Brittain

[57] ABSTRACT

In the manufacture of large signs, flexible sign facing material is fastened in stretched condition to a frame which is collapsed for shipping and erected at the job site to eliminate slack and restore its full length. Slide locking members are utilized.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 14 is confirmed.

Claims 5 and 19 having been finally determined to be unpatentable, are cancelled.

Claims 1, 6, 7, 15 and 20 are determined to be patentable as amended.

Claims 2–4, 8–13 and 16–18, dependent on an amended claim, are determined to be patentable.

New claims 21–40 are added and determined to be patentable.

1. Sign frame whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising (a) left and right end sections, each section comprising (i) a vertical member, (ii) a first horizontal member rigidly and fixedly connected to the vertical member and extending between one end of the vertical member and a free end, (iii) a second horizontal member rigidly and fixedly connected to the vertical member and extending between the other end of the vertical member and a free end, and (iv) *temporary, removable* rigid bracing means connecting the horizontal members, and (b) means for locking the left and right end sections in alignment, said locking means comprising means slidable on a horizontal member to partly encompass the free end of an adjacent horizontal member.

6. Sign frame whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising (a) *flexible sign facing material composed of flexible film,*

(*b*) left and right end sections, each section comprising (i) a vertical member, (ii) a first horizontal member rigidly and fixedly connected to the vertical member and extending between one end of the vertical member and a free end, (iii) a second horizontal member rigidly and fixedly connected to the vertical member and extending between the other end of the vertical member and a free end, [and]

(iv) rigid bracing means connecting the horizontal members, (*v*) *said sign facing material being secured under tension to said horizontal members,* and

[(b)] (*c*) means for locking the left and right end sections in alignment;

said sign frame additionally comprising at least one intermediate section, each intermediate section comprising top and bottom horizontal members, each with both ends free, and at least one bracing member connecting the horizontal members, *said sign facing material further being secured under tension to said top and bottom horizontal members* and in which the means [(b)] (*c*) is for locking the left and right end sections and the intermediate sections in alignment.

*said sign facing material constituting the sole interconnection between said intermediate section and said left and right end sections when said sign frame is collapsed and said sections are folded upon each other.*

7. Sign frame [as recited in claim 6,] *whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising*

(*a*) *left and right end sections, each section comprising*

(*i*) *a vertical member,*

(*ii*) *a first horizontal member rigidly and fixedly connected to the vertical member and extending between one end of the vertical member and a free end,*

(*iii*) *a second horizontal member rigidly and fixedly connected to the vertical member and extending between the other end of the vertical member and a free end, and*

(*iv*) *rigid bracing means connecting the horizontal members, and*

(*b*) *means for locking the left and right end sections in alignment;*

*said sign frame additionally comprising at least one intermediate section, each intermediate section comprising top and bottom horizontal members, each with both ends free, and at least one bracing member connecting the horizontal members, and in which the means (b) is for locking the left and right end sections and the intermediate sections in alignment,* in which said bracing means and said bracing [members] *member* are removable.

15. Sign frame whereby flexible sign facing material can be factory installed on said frame in the manufacture of fascias having a *longitudinal* dimension exceeding 12 feet to provide an assembly which can be collapsed *to reduce the longitudinal dimension* for transportation and restored to full length at the job site, said sign frame comprising (a) *flexible sign facing material,*

(*b*) left and right end sections, each section comprising (i) a vertical member, (ii) a first horizontal member extending between one end of the vertical member and a free end, (iii) a second horizontal member extending between the other end of the vertical member and a free end, [and]

(iv) *said sign facing material being secured under tension to said first and second horizontal members, and*

(*v*) *temporary, removable* bracing means connecting the horizontal members *and maintaining them in spaced apart relationship to preserve said tension of said sign facing material during transportation, said bracing means being removed at the job site,* and

[(b)](*c*) means for locking the left and right end sections in alignment, said locking means comprising means slidable on a horizontal member to partly encompass the free end of an adjacent horizontal member,

*said sign frame being interrelated in design with a light box with which it is to be associated such that when attached thereto at the job site, said first and second horizontal members of said end sections are maintained in spaced apart relationship by said light box to preserve said tension of said sign facing material when said bracing means is removed.*

20. Sign frame as recited in claim 15, in which the sign frame additionally comprises at least one intermediate section, each intermediate section comprising top and bottom horizontal members, each with both ends free, *said sign facing material further being secured under tension to said top and bottom horizontal members,* and at least one *temporary, removable* bracing member connecting the *top and bottom* horizontal members, *and maintaining them in spaced apart relationship to preserve said tension of said sign facing material secured thereto during transportation, said bracing member being removed at the job site,* and in which the means [(b)] (*c*) is for locking the left and right end sections and the intermediate [sections] *section* in alignment.

*21. Sign frame as recited in claim 15, the slidable means being slidable over the exterior of adjacent horizontal members to thereby partly encompass and surround the free ends of the adjacent horizontal members whereby to maintain the adjacent horizontal members in alignment.*

*22. Sign frame as recited in claim 15, additionally comprising first and second spacer members with the first spacer member being for insertion between the free ends of the first horizontal members and the second spacer member being for insertion between the free ends of the second horizontal members, and in which the slidable means confine the spacer members between the free ends of the horizontal members, said sign facing material secured to the spacer members.*

*23. Sign frame as recited in claim 15, the flexible sign facing material having a front panel surrounded by a marginal edge fastening region, each said horizontal member having a front side over which the front panel of the flexible sign facing extends and a rear fastening side spaced from and opposite said front side over which said marginal edge fastening region of said flexible sign facing extends and is fastened directly thereto under tension, each said horizontal member containing a plurality of holes on its rear fastening side for receiving fasteners used in fastening said marginal edge fastening region directly to said fastening side of said horizontal member.*

*24. Sign frame as recited in claim 23 in which said marginal edge fastening region of said sign facing material is secured directly to said rear fastening side of said horizontal member by pop rivets extending through both said marginal edge fastening region and said holes.*

*25. Sign frame as recited in claim 15, said sign facing material being secured under tension to said first and second horizontal members adjacent said free ends thereof.*

*26. Sign frame as recited in claim 15, said sign facing material being in a sign facing plane in each said end section, said bracing means of each said end section including an elongated member which throughout its length is proximate said sign facing plane in said end section.*

*27. Sign frame as recited in claim 26, said elongated member of each said end section extending between confronting surfaces of said horizontal members of said end section.*

*28. In combination, the sign frame of claim 15 attached to said light box with which it is interrelated in design and said temporary, removable bracing means being removed, said first and second horizontal members of said end sections being maintained in spaced apart relationship by said light box to preserve said tension of said sign facing material with said bracing means removed.*

*29. Sign frame as recited in claim 9, the slidable means being slidable over the exterior of adjacent horizontal members and any spacer member therebetween to thereby partly encompass and surround the spacer and the free ends of the adjacent horizontal members whereby to maintain the spacer and adjacent horizontal members in alignment.*

*30. Sign frame as recited in claim 14, the slidable means being slidable over the exterior of adjacent horizontal members and any spacer member therebetween to thereby partly encompass and surround the spacer and the free ends of the adjacent horizontal members whereby to maintain the spacer and adjacent horizontal members in alignment.*

*31. Sign frame as recited in claim 1, the slidable means being slidable over the exterior of adjacent horizontal members to thereby partly encompass and surround the free ends of the adjacent horizontal members whereby to maintain the adjacent horizontal members in alignment.*

*32. Sign frame whereby flexible sign facing material composed of flexible film can be installed away from the job site on said frame in the manufacture of fascias having a longitudinal dimension exceeding 12 feet to provide an assembly which can be collapsed to reduce only the longitudinal dimension for transportation and restored to full length at the job site, said sign frame comprising*

(*a*) *sign facing material composed of flexible film,*

(*b*) *left and right end sections, each section comprising*

(*i*) *a vertical member,*

(*ii*) *a first horizontal member rigidly and fixedly connected to the vertical member and extending between one end of the vertical member and a free end,*

(*iii*) *a second horizontal member rigidly and fixedly connected to the vertical member and extending between the other end of the vertical member and a free end,*

(*iv*) *said sign facing material being secured under tension to said first and second horizontal members,*

(*v*) *temporary, removable rigid bracing means connecting the horizontal members and maintaining them in spaced apart relationship to preserve said*

*tension of said sign facing material during transportation, said bracing means being removed at the job site, and*

*(c) means for locking the left and right end sections in alignment;*

*said sign frame additionally comprising at least one intermediate section, each intermediate section comprising top and bottom horizontal members, each with both ends free, said sign facing material further being secured under tension to said top and bottom horizontal members, and at least one temporary, removable bracing member connecting the top and bottom horizontal members and maintaining them in spaced apart relationship to preserve said tension of said sign facing material secured thereto during transportation, said bracing member being removed at the job site, and in which the means (c) is for locking the left and right end sections and the intermediate sections in alignment,*

*said sign frame being interrelated in design with a light box with which it is to be associated such that when attached thereto at the job site, said horizontal members of each said section are maintained in spaced apart relationship by said light box to preserve said tension of said sign facing material when said bracing means and bracing member are removed.*

*33. Sign frame as recited in claim 32, the flexible sign facing material having a front panel surrounded by a marginal edge fastening region, each said horizontal member having a front side over which the front panel of the flexible sign facing extends and a rear fastening side spaced from and opposite said front side over which said marginal edge fastening region of said flexible sign facing extends and is fastened directly thereto under tension, each said horizontal member containing a plurality of holes on its rear fastening side for receiving fasteners used in fastening said marginal edge fastening region directly to said fastening side of said horizontal member.*

*34. Sign frame as recited in claim 33 in which said marginal edge fastening region of said sign facing material is secured directly to said rear fastening side of said horizontal member by pop rivets extending through both said marginal edge fastening region and said holes.*

*35. Sign frame as recited in claim 32, said sign facing material being secured under tension to said horizontal members adjacent said free ends thereof.*

*36. Sign frame as recited in claim 32, in which the sign frame additionally comprises top and bottom spacer members for each intermediate member to be inserted between the free ends of the horizontal members on one side of the intermediate member and the free ends of adjacent horizontal members, said sign facing material further being secured to said spacer members.*

*37. Sign frame as recited in claim 32, said sign facing material being in a sign facing plane in each said section, said bracing means of each said end section including an elongated member which throughout its length is proximate said sign facing plane in said end section, said bracing member of said intermediate section being an elongated member which throughout its length is proximate said sign facing plane in said intermediate section.*

*38. Sign frame as recited in claim 37, said elongated member of each said section extending between confronting surfaces of said horizontal members of said section.*

*39. In combination, the sign frame of claim 32 attached to said light box with which it is interrelated in design and said temporary, removable bracing means and bracing member being removed, said horizontal members of said sections being maintained in spaced apart relationship by said light box to preserve said tension of said sign facing material with said bracing means and bracing member removed.*

*40. Sign frame whereby flexible sign facing material can be factory installed on said frame in the manufacture of fascias having a longitudinal dimension exceeding 12 feet to provide an assembly which can be collapsed to reduce the longitudinal dimension for transportion and restored to full length at the job site, said sign frame comprising*

*(a) flexible sign facing material,*

*(b) left and right end sections, each section comprising*

*(i) a vertical member,*

*(ii) a first horizontal member extending between one end of the vertical member and a free end,*

*(iii) a second horizontal member extending between the other end of the vertical member and a free end, and*

*(iv) bracing means connecting the horizontal members,*

*(v) said sign facing material being secured under tension to said first and second horizontal members, and*

*(c) means for locking the left and right end sections in alignment, said locking means comprising means slidable on a horizontal member to partly encompass the free end of an adjacent horizontal member,*

*said sign facing material constituting the sole interconnection between said left and right end sections when said sign frame is collapsed and said end sections are folded upon each other.*

* * * * *